US006024212A

United States Patent [19]

Whitnell

[11] Patent Number: 6,024,212

[45] Date of Patent: Feb. 15, 2000

[54] CUP CARRIER

[75] Inventor: Simon Whitnell, Exton, Pa.

[73] Assignee: Dopaco, Inc., Exton, Pa.

[21] Appl. No.: 09/207,772

[22] Filed: Dec. 9, 1998

[51] Int. Cl.[7] ..... B65D 75/00

[52] U.S. Cl. ..... 206/185; 206/198

[58] Field of Search ..... 206/162, 170, 206/174, 175, 180, 185, 188, 193, 198, 427; 229/108, 112, 120.12

[56] References Cited

U.S. PATENT DOCUMENTS

| | | | |
|---|---|---|---|
| 1,824,762 | 9/1931 | Bloom . | |
| 2,543,821 | 3/1951 | Arneson | 206/180 |
| 2,794,571 | 6/1957 | Fielding . | |
| 2,808,177 | 10/1957 | Buttery . | |
| 2,821,328 | 1/1958 | Ramsay | 206/180 |
| 2,874,833 | 2/1959 | Toensmeier . | |
| 2,927,721 | 3/1960 | Thatcher | 229/120.12 |
| 4,062,487 | 12/1977 | Bliss . | |
| 4,207,978 | 6/1980 | Patterson et al. | 206/198 |
| 4,312,446 | 1/1982 | Summers | 206/198 |
| 4,601,390 | 7/1986 | Rosenthal et al. . | |
| 4,782,943 | 11/1988 | Blackman . | |
| 4,838,414 | 6/1989 | Blackman | 206/188 |
| 5,069,335 | 12/1991 | Beales | 206/180 |
| 5,221,001 | 6/1993 | Eisman | 206/180 |
| 5,558,224 | 9/1996 | Fogle . | |

*Primary Examiner*—Paul T. Sewell
*Assistant Examiner*—Luan K. Bui
*Attorney, Agent, or Firm*—Dennison, Meserole, Scheiner & Schultz

[57] ABSTRACT

A cup carrier with a basket having the general configuration of an upwardly opening diamond with a diagonally transverse partition and handle extending vertically above and dividing the basket into a pair of separate upwardly opening triangular compartments.

18 Claims, 2 Drawing Sheets

CUP CARRIER

BACKGROUND OF THE INVENTION

Carriers conventionally formed of folded paperboard or cardboard to accommodate multiple beverage cups or like containers are well known and commonly used, particularly in fast food or carry-out restaurants. Such carriers, in addition to allowing for the convenient carrying of multiple cups, can also function as a holder for cups upon a placing of the carrier on a table, counter top, or the like.

However, as beverage cups have become increasingly larger, the ability of the conventional handled carrier to handle the cups is reduced. While this problem is not particularly noticeable in carriers adapted to contain two or more rows of drinking cups, for example four cups in a square carrier, the problem is particularly acute with regard to 2-cup carriers with the cups aligned within a narrow carrier of a transverse width approximately that of the width of the received cups. Any degree of lateral stability will only result from a perfectly planar base on the carrier and a perfectly planar support surface, tabletop or the like. As the standard heights of the cups increase, particularly as the conventional cups normally increase in diameter upward from a narrow lower end, the problems of maintaining lateral stability to the carrier also increase.

It is to be appreciated that while carriers of the type involved herein are referred to as cup carriers, the word cup is intended to encompass equivalent beverage containers such as soda or beer bottles and cans, juice jars, and the like.

SUMMARY OF THE INVENTION

It is a primary object of the present invention to provide a 2-cup carrier, with a central transverse handle and useable in the manner of a conventional carrier, which forms a highly stable base to effectively resist any tendency for an accidental lateral tipping of the carrier and a spilling of the contents of the cups or other similar beverage containers carried therein. In achieving the desired stability, the carton is so formed as to provide a support base which extends both laterally and longitudinally substantially beyond the effective cup-receiving area of each of the two compartments. This cup-receiving area is usually defined by the normally cylindrical configuration of the cup or beverage container received therein and/or by any restrictions arising from the configuration of the mouth of the compartment.

The principal objects of the invention are achieved while maintaining the desired characteristics of the conventional handled carrier, including utilizing minimal material, allowing for use of known manufacturing techniques, and in particular an ability to be readily expanded from a flat storage position to an erected in-use position at the point of use. The proposed carrier also presents an easily stored configuration when collapsed, and an erected configuration which allows for compact side-by-side positioning of multiple carriers.

More specifically, the carrier, formed with two longitudinally aligned cup-receiving compartments, is transversely divided on a diagonal by a partition formed of a pair of oppositely extending partition panels integral with the walls of the basket portion of the carrier and extending inward in overlying relation to each other from opposed corners.

The basket or basket portion of the carrier is defined by four walls joined at the corners and providing a continuous peripheral wall. Each of these walls are preferably of equal length and form a quadrilateral, preferably a rhombus or diamond configuration in plan which, when divided by the handle-forming partition, defines two triangular compartments. Each of the compartments is formed by the partition and two walls outwardly converging from opposite edges of the partition to a remote corner, thus forming a triangular configuration with the base or widest portion thereof at the partition.

Inasmuch as the containers to be received in the compartments will normally be circular in cross-section, although other shaped containers can also be accommodated, the relationship of the cup to the container will be in the nature of an inscribed circle within a triangle whereby the corner portions of the triangle, that is the basket compartment, extend both laterally and longitudinally outward of the received cup. In this manner, a substantial degree of additional stability is provided in the carrier of the invention as opposed to a conventional rectangular carrier, the width and length of which is substantially equal to that of the received cups.

In the formed carrier of the invention, as the two longitudinally aligned triangular compartments will in themselves provide a substantial degree of longitudinal stability, that is a resistance of the carrier to tip in a longitudinal direction, that of the longest diagonal, it is possible that the longitudinally aligned corners can be truncated, that is defined by a relatively narrow flat end wall. It is more important, and in fact significant to the present invention, that the walls diverge from each longitudinal corner or corner portion outwardly to the ends of the transverse or shorter diagonal at the opposed side edges of the partition to ensure a positive laterally outward extension of the basket beyond the lateral extremes of the received cups or containers to avoid any possibility of an accidental lateral tipping of the filled carrier.

The bottom of the carrier is in the nature of a self-erecting bottom which utilizes folding and interlocking bottom flanges in generally a known manner and which tend to retain the carrier in its open position for the placing of cups therein.

The carrier is to fold, subsequent to the manufacture thereof, for both storage and shipping, and to be erected at the point of use. As such, the combined partition and handle is formed of two separate partition panels, each integral with a side wall of the basket of the carrier. These panels are, as the carrier is unfolded, brought into alignment with each other and manually interlocked by engaging lugs and openings, as well as a locking flange associated with the hand grip portion of the partition. This interlocking of the partition panels also assists the self-erecting bottom in maintaining the carrier in its open or unfolded position.

Other details, features and objects will become apparent from the following more comprehensive description of the invention.

DESCRIPTION OF PREFERRED EMBODIMENT

Figure 1:
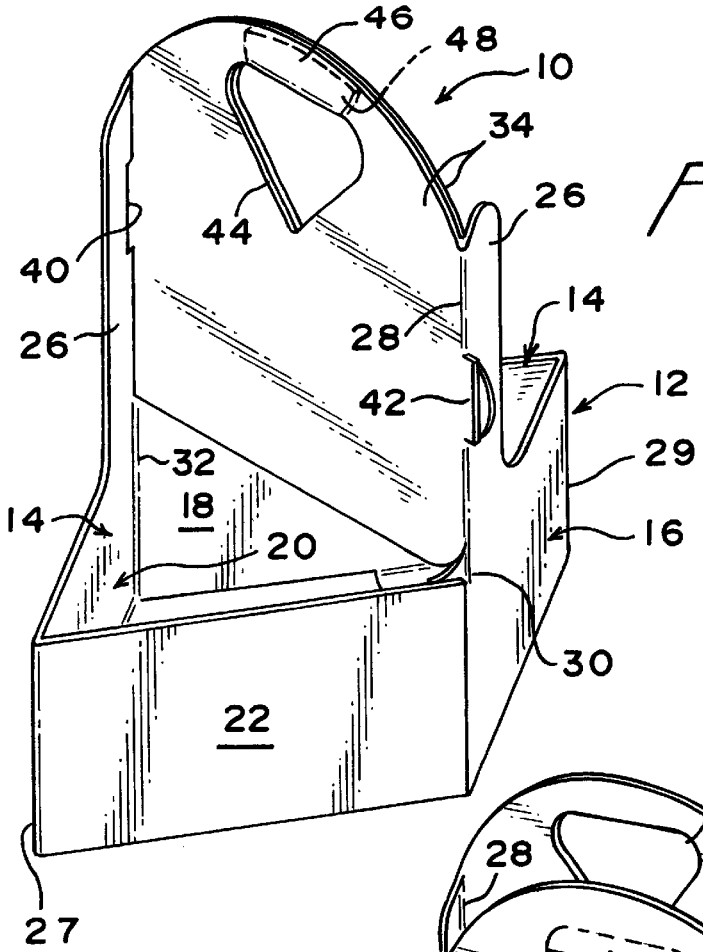
FIG. 1 is a perspective view of the carrier fully erected.

Referring now more specifically to the drawings, the carrier 10 is a 2-cup carrier having a lower basket portion 12 formed with two longitudinally aligned compartments 14. The basket is elongate and of a substantially rhombus or diamond configuration and formed by four equal length vertically extending walls 16, 18, 20 and 22. The walls are joined along the full height of the upwardly extending corners of the basket 12 with the walls integral at three of the basket corners and fixedly joined at the fourth corner utilizing a generally full-height glue flap 24 on an outer edge of one wall 16 which is adhesively bonded in underlying relation to an adjoining edge portion of the adjacent wall 20.

In the preferred rhombus configuration of the basket, the two diagonally opposed acute corners 27 and 29 formed by the joined walls define the length of the basket or carrier along which the two basket compartments are aligned. The diagonally opposed oblique corner 30 and 32 define the maximum transverse width of the basket and carrier centrally between the longitudinal extremes of the carrier.

The walls 16 and 20 each include an integral vertical wall extension 26. The extensions 26 extend from the upper edges of opposed walls 16 and 20, and have inner vertical edges 28 aligned with the transverse aligned corners 30 and 32, respectively between walls 16 and 22, and between walls 20 and 18. The wall extensions parallel each other at a spacing equal to that of the walls 16 and 20.

A laterally extending partition panel 34 is integral with and folded from each of the laterally aligned inner edges 28 of the opposed wall extensions 26 to extend diagonally across the basket between opposed corners 30 and 32 at the maximum transverse width of the basket 12. Each of the partition panels 34, along the outer free edge 36 thereof, is provided with at least one coplanar outwardly projecting locking lug 38 closely received through an aperture 40 in the opposed wall extension 26 for a locking of the partition panels in adjoining face-to-face engagement. The apertures 40 are defined within the wall extensions 26 by projections 42 coplanar with each partition panel 34 and defined by cut lines in the corresponding wall extension 26 to the opposite side of the fold line defining edge 28. The configuration of these projections provide apertures 40 which snugly receive and frictionally retain the lugs 38 with the projections 42 immediately overlying the aperture-received lugs 38 and providing a stabilizing backing therefor.

The upper portions of the partition panels 34 extend slightly above the side wall extensions 26 and have, in the erected carrier 10, aligned generally triangular openings 44 therethrough for accommodating the fingers of a hand and to define a hand grip portion 46 immediately thereabove. The openings 44 include transverse upper edges with one of the apertures having an integral retention flap 48 depending from this edge and foldable about the upper edge of the aperture in the adjacent partition panel 34, providing in effect a smooth and partially cushioned hand grip as well as a means for additionally preventing accidental separation of the partition panels, particularly within the hand grip area.

Figure 2:
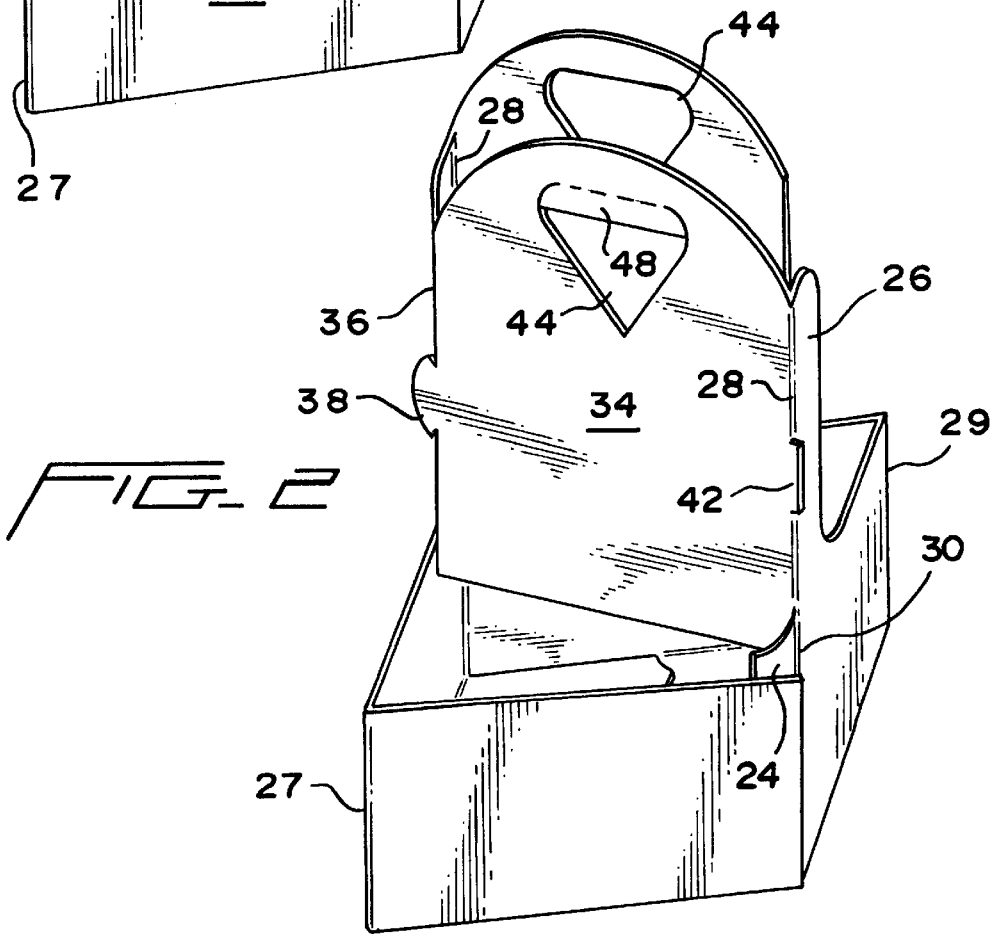
FIG. 2 illustrates the carrier at a step prior to its fully folded position.

As suggested in FIG. 2, the carrier, with the partition panels 34 prior to an inward folding thereof, can be in a flat folded position to facilitate shipping, storage and the like. In erecting the carrier to its in-use position, the opposed longitudinal outer edge corners 27 and 29 thereof are inwardly moved toward each other with the bottom self-erecting to retain the basket portion 12 in its diamond configuration. The opposed partition panels 34 are then folded inwardly into overlying relation and the locking lugs 38 engaged within the appropriate locking apertures 40. Note FIG. 1. The erected carrier is completed by the wrap-around folding of the retention flap 48.

The erected carton is now capable of receiving two cups up to a size which can be downwardly inserted through the upwardly opening mouths and within the walls of the compartments 14. In light of the angular relationship between the walls, the base or bottom of the basket, upon which the cups sit, will extend an appreciable distance laterally and longitudinally outward of the periphery of the received cups. At the same time, the converging walls of the compartments provide for a possible engagement of at least two walls of a compartment with any received cup. This will substantially enhance the lateral stability of the carrier, as opposed to the conventional carrier wherein the base or bottom of the carrier is substantially no larger than the cups themselves, and in which the normal right-angle vertical walls provide little lateral bracing.

As desired, and in those instances wherein the additional longitudinal stability provided by the peaked longitudinal corners is not required, the longitudinal corner portions may be truncated, that is provided with a narrow transverse end wall.

Figure 3:
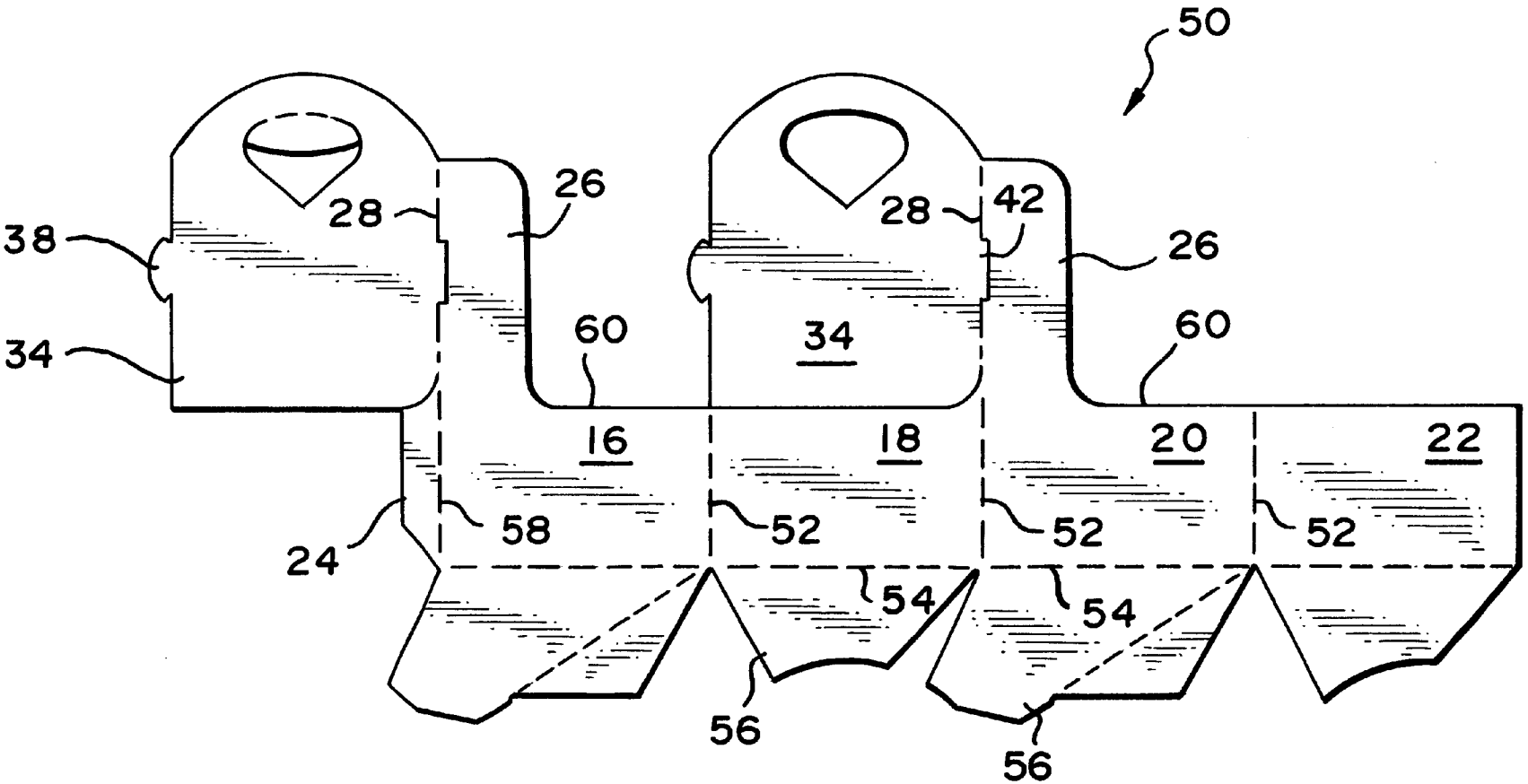
FIG. 3 is a plan view of the unitary blank from which the carrier is formed.

FIG. 3 illustrates the unitary blank 50 from which the carrier of FIG. 1 is folded. For purposes of explanation, the panels thereof have been designated by the reference numerals applied to the components formed therefrom in the carrier.

The blank 50 is longitudinally elongate with the wall panels 16–22 joined at adjacent side edges by fold lines 52 between adjacent panels and extending at 90° to the base edges 54. Bottom flaps or panels 56, which define the automatically folding bottom of the carrier, are integrally formed along each of the base edges 54 with the base edges defining a fold line for an appropriate inward folding and interlocking of the bottom panels 56 as the carrier is folded.

The wall panels 16–22 are of equal length along the length of the blank 50 with the wall panel 16 and the wall panel 22 defining the end-most wall panels of the blank. The end-most panel 16 has the glue flap 24 integral with the outer-most edge thereof for selective folding therefrom along fold line 58.

The wall extension panels 26 are integral with and extend upward perpendicular to the corresponding upper edges 60 of the wall panels 16 and 20. A first one of the partition panels 34, integral with the wall extension panel 26 extending from wall panel 16, extends over the glue flap 24 and longitudinally therebeyond. The second partition panel 34 extends longitudinally coextensive with the wall panel 18 and has the lower edge thereof defined by a cut line at the upper edge 60 of the wall panel 18 so as to fold freely relative thereto.

While the configuration of the basket, and hence the carrier, has been principally defined as being preferably a oblique-angled equilateral parallelogram, that is a rhombus or diamond shape, other generally similar quadrilateral configurations, such as a square or rhomboid, that is a parallelogram with only the opposite sides being equal, are also possible as may best accommodate specific containers. In each instance, the defined compartments will be triangular with the maximum transverse width being defined centrally along the length thereof and with the partition and handle positioned between the corners defining this maximum transverse width to form a base wall for the opposed longitudinally aligned compartments which are further defined by longitudinally extending converging walls terminating in longitudinally aligned corners.

The foregoing is illustrative of the invention. While selected embodiments have been disclosed, modifications or variations thereof may occur to those skilled in the art. As such, it is intended that the invention encompass all embodiments as may fall within the scope of the claims following hereinafter.

What is claimed is:

1. A compartmented carrier for cups, said carrier comprising an upwardly opening basket including a bottom and peripheral walls extending substantially vertically from said bottom and defining a polygonal configuration with first diagonally opposed corner portions, partition means extending between said corner portions and forming two longitudinally aligned upwardly opening compartments to opposite sides of said partition means, said compartments each including first and second walls converging outward from said partition means at said first diagonal corner portions and forming a progressively narrowing configuration for each compartment outward from said partition means, said partition means extending above said basket and terminating in a handle vertically above said basket.

2. The carrier of claim 1 wherein said basket is of a quadrilateral configuration.

3. The carrier of claim 2 wherein said basket is of an equilateral configuration.

4. The carrier of claim 3 wherein each of said compartments is of a triangular configuration.

5. The carrier of claim 4 wherein said partition means includes wall extensions integral with one of said walls of each compartment and extending upward therefrom in opposed relation to each other and at a lateral spacing substantially equal to a lateral spacing between said first diagonal corner portions.

6. The carrier of claim 5 wherein said partition means further includes a pair of partition panels, each integral with and extending from a respective one of the spaced wall extensions transversely across said basket to the opposed wall extension.

7. The carrier of claim 6 wherein each partition panel has a free outer edge engagable with said opposed wall extension, said outer edge having at least a projecting locking lug extending therefrom, each of said wall extensions having an aperture receiving the locking lug of the partition panel extending thereto.

8. The carrier of claim 2 wherein said partition means includes wall extensions integral with one of said walls of each compartment and extending upward therefrom in opposed relation to each other and at a lateral spacing substantially equal to a lateral spacing between said first diagonal corner portions.

9. The carrier of claim 8 wherein said partition means further includes a pair of partition panels, each integral with and extending from a respective one of the spaced side wall extensions transversely across said basket to the opposed side wall extension.

10. The carrier of claim 9 wherein each partition panel has a free outer edge engagable with said opposed wall extension, said outer edge having at least a projecting locking lug extending therefrom, each of said wall extensions having an aperture receiving the locking lug of the partition panel extending thereto.

11. The carrier of claim 2 wherein partition means bisect said diagonal corner portions.

12. The carrier of claim 11 wherein said compartments are of a triangular configuration with a common base edge defined by said partition means.

13. The carrier of claim 12 wherein said partition means includes wall extensions integral with said walls and extending upward therefrom in parallel relation to each other and at a lateral spacing, said partition means further including a pair of partition panels, each integral with and extending from a respective one of the spaced side wall extensions transversely across said basket to the opposed wall extension.

14. A handled foldable paperboard carrier comprising peripheral walls defining an upwardly opening basket having an open top, said basket including a closed bottom joined to and extending between said walls, said walls being substantially equilateral and end joined at corner portions forming first diagonally opposed generally oblique angles and second diagonally opposed generally acute angles to define a diamond configuration, and partition means spaced apart from said bottom and extending between and bisecting said first diagonally opposed oblique angle corner portions wherein a triangular compartment is formed to opposed sides of said partition means.

15. The carrier of claim 14 wherein said partition means is connected to at least one of said walls along a fold line normal to said bottom.

16. The carrier of claim 14 wherein said partition means comprises first and second partition elements, said first partition element connected to a single one of said walls along a first fold line normal to said bottom and said second partition element connected to an opposed one of said walls along a second fold line normal to said bottom.

17. A handled foldable paperboard carrier comprising peripheral walls defining an upwardly opening basket, said basket including a closed bottom joined to and extending between said walls, said walls being substantially equilateral and end joined at corner portions forming first diagonally opposed generally oblique angles and second diagonally opposed generally acute angles to define a diamond configuration, and partition means extending between and bisecting said first diagonally opposed oblique angle corner portions wherein a triangular compartment is formed to opposed sides of said partition means and wherein said partition means extends above said basket walls and includes wall extensions integral with one of the walls of each compartment and extending upward therefrom in opposed relation to each other and at a lateral spacing substantially equal to a lateral spacing between said first diagonal corner portions and a pair of partition panels, each integral with and extending from a respective one of the spaced wall extensions transversely across said basket to the opposed wall extension.

18. A foldable paperboard blank for use in the formation of a two compartment carrier, said blank comprising four longitudinally joined wall panels with transverse fold lines between adjacent panels, said panels being aligned relative to adjacent panels, said panels having upper and lower edges, bottom panels integral with said wall panels along said lower edges with fold lines defined between said wall panels and said bottom panels, said wall panels comprising a first wall panel at a first end of said blank, a second wall panel longitudinally adjacent thereto, a third wall panel longitudinally adjacent said second wall panel, and a fourth wall panel longitudinally adjacent said third wall panel, said first wall panel having an outer edge with a glue flap integral therewith and foldable relative thereto along a fold line defined between said first wall panel and said glue flap, a first side wall extension panel integral with said first wall panel upper edge and extending upward therefrom, a first partition panel integral with said first extension panel and extending laterally therefrom with a fold line therebetween, said first partition panel overlying and extending laterally beyond said glue flap, a second side wall extension panel integral with said third wall panel upper edge and extending upward therefrom, a second partition panel integral with a second extension panel and extending therefrom with a fold line therebetween, said second partition panel extending laterally over said second wall panel and being separable from the upper edge thereof.

* * * * *